US005178312A

United States Patent [19]

Iida

[11] Patent Number: 5,178,312

[45] Date of Patent: Jan. 12, 1993

[54] BACKPACK FRAME AND PRODUCTION METHOD THEREFOR

[75] Inventor: Giichi Iida, Tokyo, Japan

[73] Assignee: Kioritz Corporation, Tokyo, Japan

[21] Appl. No.: 704,692

[22] Filed: May 17, 1991

Related U.S. Application Data

[63] Continuation of Ser. No. 432,634, Nov. 7, 1989, abandoned.

[30] Foreign Application Priority Data

Nov. 10, 1988 [JP] Japan ..... 63-282409

[51] Int. Cl.[5] ..... A45F 3/08

[52] U.S. Cl. ..... 224/261; 224/210; 220/62

[58] Field of Search ..... 224/209, 210, 211, 212, 224/261, 262, 263; 220/62, 62.1, 6

[56] References Cited

U.S. PATENT DOCUMENTS

| | | | |
|---|---|---|---|
| 2,563,195 | 8/1951 | Soule et al. | 224/263 |
| 3,446,415 | 5/1969 | Bromley | 220/62 |
| 3,539,110 | 11/1970 | Kobayashi . | |
| 3,549,064 | 12/1970 | Wilson | 224/209 |
| 4,082,208 | 4/1978 | Lane, Jr. | 224/209 |
| 4,217,998 | 8/1980 | Alexander | 224/210 |
| 4,223,819 | 9/1980 | Wright | 224/211 |
| 4,290,165 | 9/1981 | Hiramatsu et al. . | |
| 4,934,573 | 6/1990 | Jaeger | 224/210 |
| 4,953,735 | 9/1990 | Tisbo et al. | 220/62 |

FOREIGN PATENT DOCUMENTS 1229333 6/1967 Fed. Rep. of Germany .

*Primary Examiner*—Linda J. Sholl
*Attorney, Agent, or Firm*—Browdy and Neimark

[57] ABSTRACT

A backpack frame comprises a main frame portion and right and left guard portions, which are integrally formed at the both sides of the main frame portion through thin wall portions and which are respectively bent at the thin wall portions toward one side of the main frame portion, the main frame portion and the guard portions being connected and fixed to each other to from a U-shaped form as a whole.

7 Claims, 4 Drawing Sheets

BACKPACK FRAME AND PRODUCTION METHOD THEREFOR

This application is a continuation of application Ser. No. 07/432,634, filed Nov. 7, 1989, now abandoned.

BACKGROUND OF THE INVENTION

The present invention relates to a backpack frame and a method of producing the same.

For example, in backpack type machines such as chemical spreaders or the like, the main machine part such as an internal combustion engine or the like is mounted on a backpack frame so that the backpack frame is carried on the back of an operator during work. Such frames are generally formed into an L-shaped frame having a pedestal, which backwardly projects, by bending a pipe material such as a metal pipe and joining it by welding. Although such L-shaped frames can be formed integrally by using plastic materials, it is difficult to form each frame comprising parts having a given uniform thickness. Conventional frames are therefore produced and assembled at high cost. In addition, since it is necessary to use various materials having different thicknesses in accordance with the level of the load applied, the material cost is high. There are also problems in that the heavy weight of the frame apparatuses themselves loads the operator, and there is danger of damaging the machines mounted on the frames because the frames have substantially no means for protecting the machines. There is further a problem in that, since the frames must be shipped from factories as final products which are completely assembled, the transportation cost is high.

SUMMARY OF THE INVENTION

Accordingly, it is an object of the present invention to provide a backpack frame which involves none of the problems of the prior art and which has a simple structure and is convenient for use.

A backpack frame in accordance with the present invention comprises a main frame portion, and right and left guard portions which are respectively formed on both sides of the main frame portion integrally therewith through thin wall portions and which are bent to one side of the main frame at the thin wall portions, the main frame portion and the guard portions being joined to each other and fixed to form a U-shaped form as a whole.

The backpack frame in accordance with the present invention also comprises a main frame portion and right and left guard portions which are respectively formed on both sides of the main frame portion integrally therewith through thin wall portions and which are integrally formed into plate forms by a blow molding method using a plastic material and are then bent to one side of the main frame portion at the thin wall portions to form a U-shaped frame comprising the guard portions and the main frame portion, which are joined to each other and fixed.

It is therefore possible to form a frame that has a U-shaped box-like structure that is of light weight and protects a machine mounted or loaded on it by the guard portions on the both sides thereof, and to easily mold and assemble the frame in separate places.

The present invention as configured above is of light weight and has a structure of high strength, as compared with conventional frames, and is capable of effectively protecting a machine mounted on so as to prevent damage to the machine. The present invention also enables a reduction in the production cost of the frame by virtue of mass production and a reduction in the transportation cost by virtue of the ease of field assembly.

PREFERRED EMBODIMENT OF THE INVENTION

Figure 1:
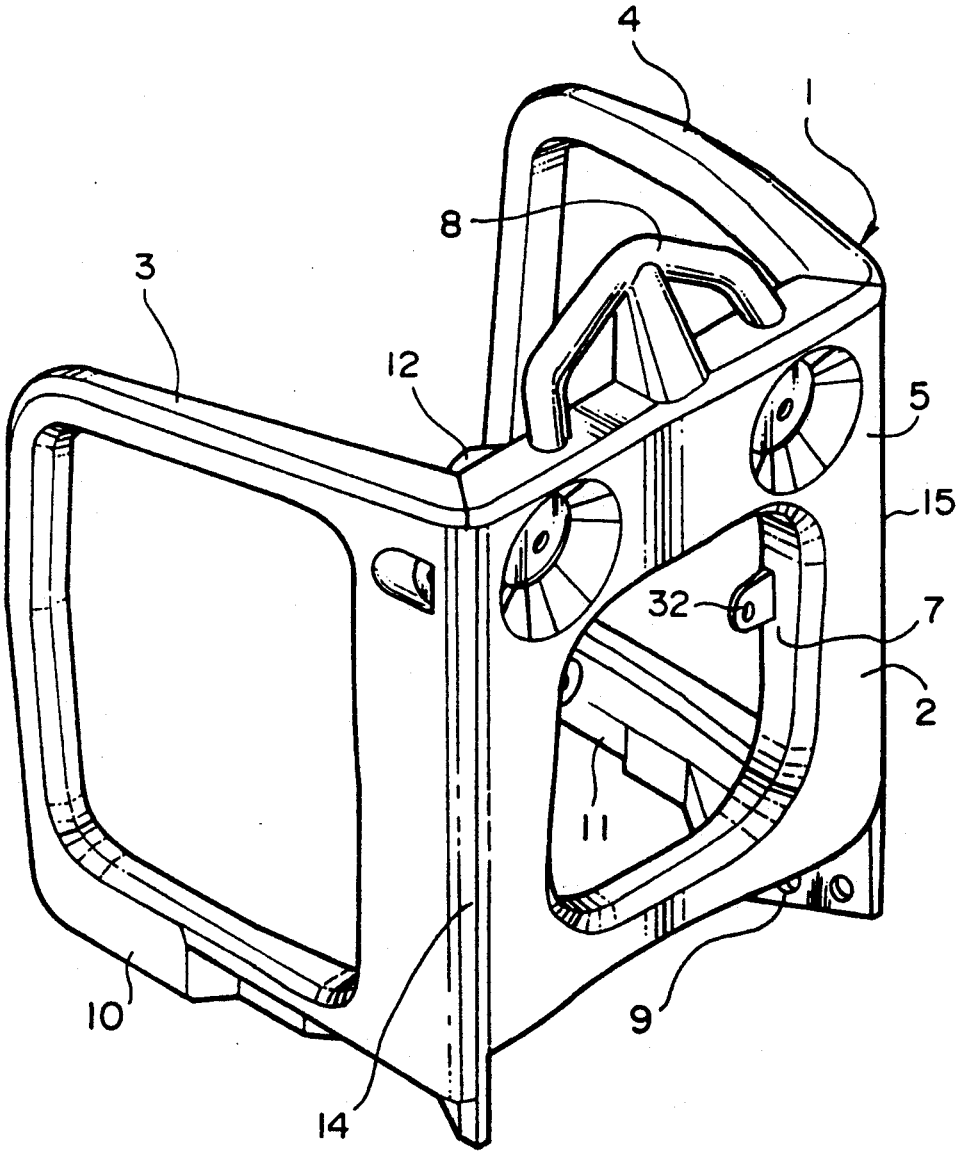
FIG. 1 is a perspective view of the front side of a backpack frame in a form completely assembled in an embodiment of the present invention, as viewed from an upper left position.

The present invention will be described below with reference to the embodiment shown in the drawings.

Figure 2:
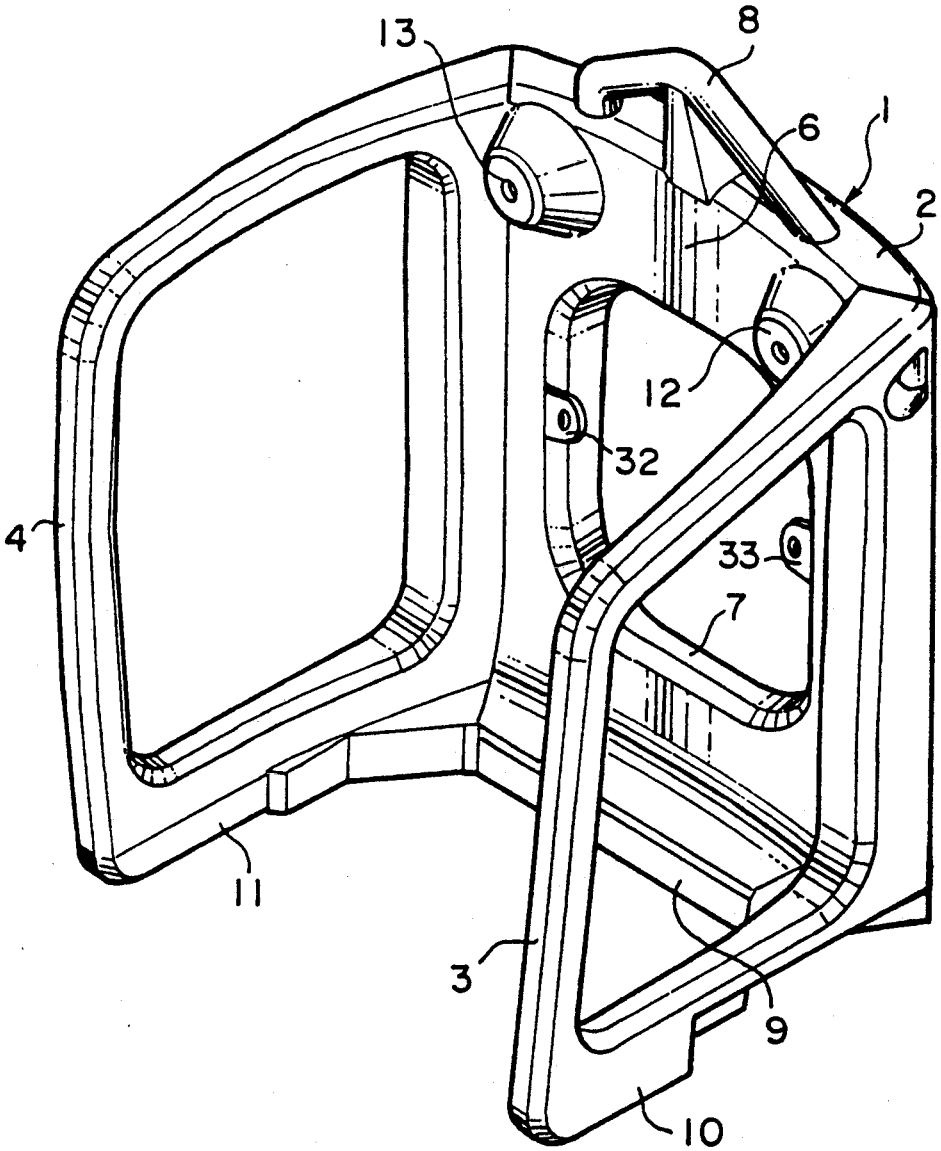
FIG. 2 is a perspective view of the rear side of the backpack frame shown in FIG. 1, as viewed from an upper right position.

FIGS. 1 and 2 are perspective views of a backpack frame in the embodiment of the present invention in a state wherein the assembly is completed. In the embodiment, a backpack frame 1 is used, for example, for a backpack type power blower or the like, and has a main frame portion 2 and a pair of right and left guard portions 3, 4, these portions being molded and assembled as described below. The main frame portion 2 has a tetragonal form as a whole and a tetragonal opening 7 which is formed at the central portion of the main frame portion 2 so as to pass therethrough from the front side 5, which forms a back supported face, to the rear side 6. This opening is considered as a portion in which a back pad (not shown) is mounted or air is introduced for a blower (not shown). In this way, the main frame portion 2 is formed into a tetragonal form. In the drawings, reference numerals 32 and 33 denote mounting bracket portions which are used for mounting the back pad or the like. The main frame portion 2 further has a shoulder belt mounting portion 8 which is integrally formed at the central portion on the upper side thereof, the lower side 9 being formed to be flat. The right and left guard portions 3, 4 have the substantially the same form of tetragonal frame and are respectively disposed so as to extend backward from both sides of the main frame portion 2. The lower sides 10 and 11 of the guard portions 3, 4 are respectively formed to be flat so as to be on a plane which is the same as the lower side 9 of the main frame portion 2. The frame 1 can be therefore stably placed and stored on a plane such as the ground or a floor. In addition, projections 12, 13 are formed in an upper portion of the rear side 6 of the main frame portion 2 so that machinery (not shown) is fitted and fixed to the projections 12, 13 and disposed in the U-shaped spacesurrounded by the main frame portion 2 and the guard portions 3, 4. The machinery installed in the frame 1 is thus protected by the guard porltions 3, 4, thereby preventing any danger of damaging it.

The above-described frame 1 is manufactured and assembled in the way described below.

Figure 3:
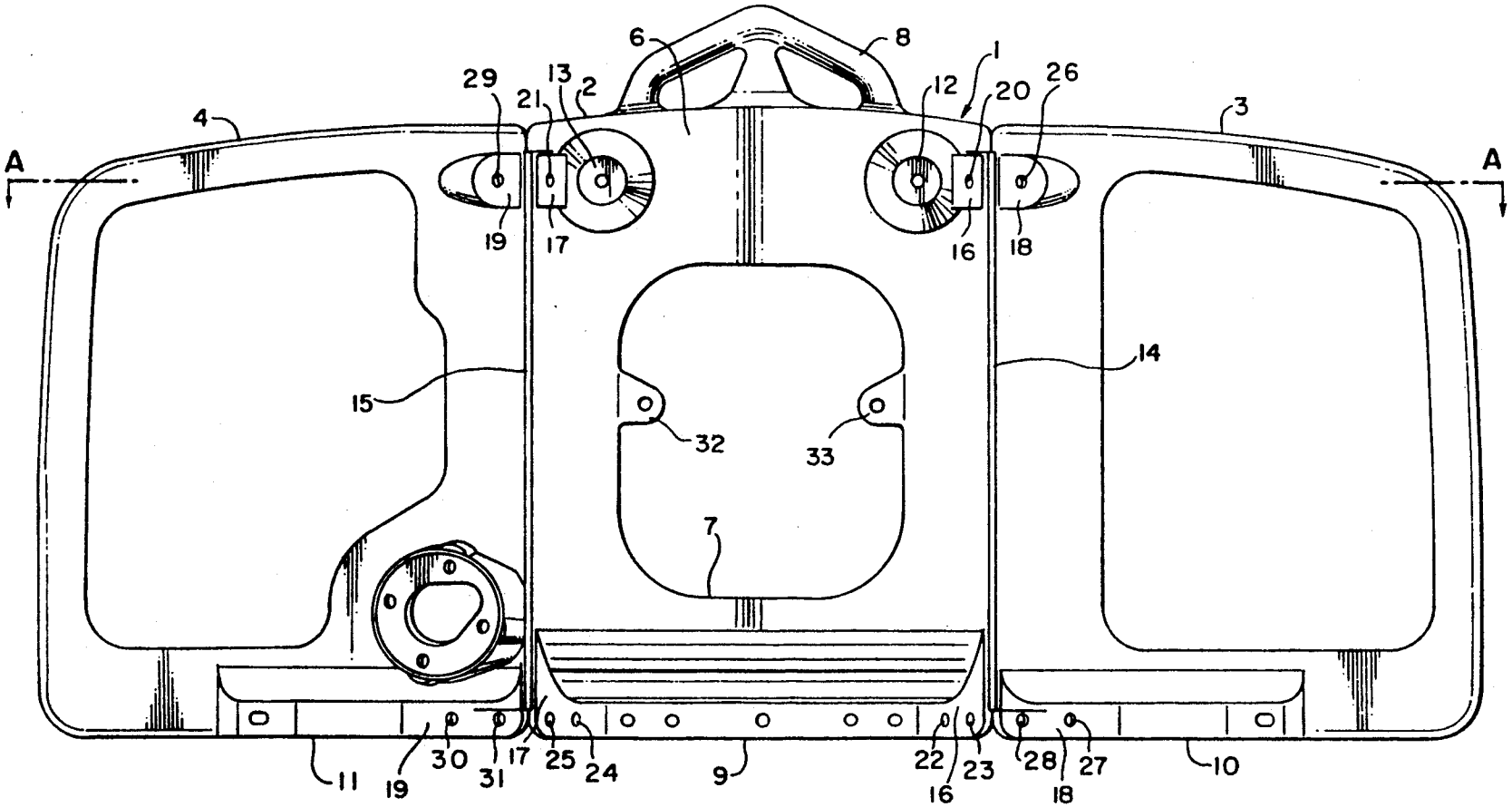
FIG. 3 is a plan view of the blank or plate immediately after the backpack frame shown in FIG. 1 has been molded.
Figure 4:
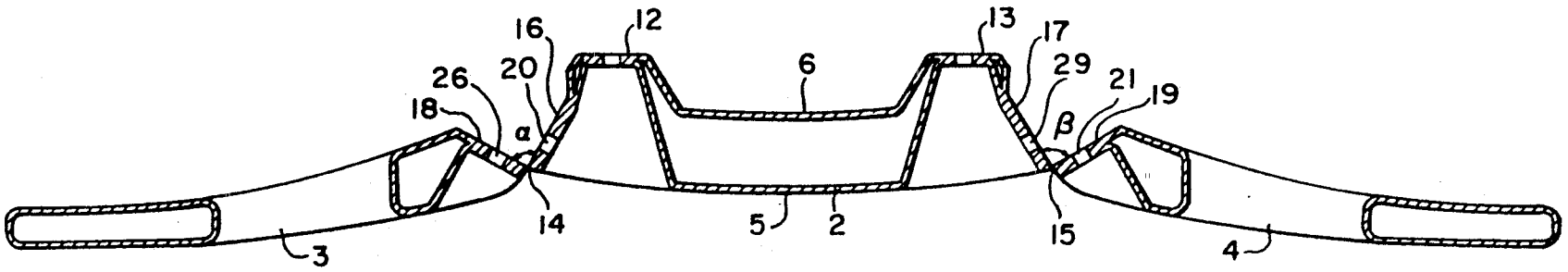
FIG. 4 is a sectional view taken along the line A—A in FIG. 3.

The frame 1 is first formed into the form of a blank or plate shown in FIGS. 3 and 4 by a blow molding method using an appropriate plastic material. During this process, each of the main frame portion 2 and the guard portions 3, 4 of the frame 1 is integrally molded into a thin wall structure having a hollow box-like form so that they are connected to each other by flexible thin wall portions 14, 15 which are respectively formed between the edges on the right and left sides of the front side 5 of the main frame portion 2 and the edges on the guard portions 3, 4. The main frame portion 2 has inclined surfaces 16, 17 which backwardly extend at a certain inward angle from the thin wall portions 14, 15, respectively, and which are respectively formed at the right and left sides of the main frame portion 2. On the other hand, the guard portions 3, 4 have inclined surfaces 18, 19, respectively, which are respectively formed at the sides thereof adjacent to the main frame portion 2 so as to backwardly extend at a certain angle from the thin wall portions 14, 15, respectively, in the direction opposite to the inclined surfaces 16, 17 of the main frame portion 2. The included angle $\alpha$ between the inclined surface 16 on the right side of the main frame portion 2 and the inclined surface 18 of the right guard portion 3 and the included angle $\beta$ between the inclined surface 17 of the left side of the main frame portion 2 and the inclined surface 19 of the left guard portion 4 are set to about 90°, as shown in FIG. 4, during molding by the blow molding method. Such a structure enables the guard portions 3, 4 to be bent about 90° at the thin wall portions 14, 15, respectively, backward with respect to the main frame portion 2 during the assembly of the frame 1 in the next process, whereby the guard portions 3, 4 can be dsposed at the positions shown in FIGS. 1 and 2.

Further, the main frame portion 2 of the frame 1 has holes 20 and 21 which are respectively formed at upper positions on the both sides of the rear side 6 so that an appropriate coupling members (not shown) such as bolts or the like can be fitted therein, as well as two pairs of holes 22, 23 and 24, 25 which are formed at lower positions on the right and left sides of the rear side 6. The right guard portion 3 has holes 26 and 27, 28 which are formed at an upper position on its rear side and lower positions on its side adjacent to the main frame portion 2 so as to correspond to the right hole 20 and the holes 22, 23, respectively. Similarly, the left guard portion 4 has holes 29 and 30, 31 which are formed at an upper position on its rear side and lower positions on its side adjacent to the main frame portion 2 so as to correspond to the left hole 21 and the holes 24, 25, respectively.

During the assembly of the frame 1, as described above, the right and left guard portions 3, 4 are backwardly bent about 90° with respect to the main frame portion 2 at the flexible film wall portions 14, 15 which are formed into a hinge-like shape, and the coupling members are fitted in the holes of the main frame portion 2 and the corresponding holes of the guard portions 3, 4 so that the frame 1 can be assembled into the form shown in FIGS. 1 and 2.

The above-mentioned arrangement provides the frame 1 with advantages in that any damage to the machinery installed therein can be prevented, and in that the frame can be mass-produced at a molding location by a blow molding method and is of light weight and has high strength because it is formed into a hollow box-shaped structure. The frame 1 also has an advantage in that, since it can be transported to any desired assembly location in a state wherein many frame apparatuses molded into flat plates, as shown in FIGS. 3 and 4, are piled up, the transportation cost is low and the assembly can be performed in the spot.

A rear cover portion may be provided by the same method as that described above so as to be linked to either the right or left guard portion.

What is claimed is:

1. A molded blank for creating a backpack frame comprising:

a substantially rectangular hollow mainframe portion formed by integrally molded thin walls, substantially rectangular hollow right and left guard portions formed by integrally molded thin walls, said mainframe portion having side edges, said right and left guard portions having side edges, a pliable wall portion connecting one of said side edges of each of said right and left guard portions to said side edges of said mainframe portion, stop means located proximate to said one of said side edges of said right and left guard portions and said side edges of said mainframe portion for positively limiting rotation of said right and left guard portion along said pliable wall portion after starting said rotation from a substantially horizontal plane with said mainframe to a final predetermined angle with said mainframe to form said backpack frame, wherein said molded blank when erected as said backpack frame permits machinery or other devices fixed to said mainframe portion to freely extend outwardly beyond top and bottom edges of said right and left guard portions and said mainframe portion.

2. The molded blank for creating a backpack frame claimed in claim 1, wherein said final predetermined angle of said right and left guard portions to said mainframe portion form a U-shaped backpack frame.

3. The molded blank for creating a backpack frame claimed in claim 1, wherein said pliable wall portion is substantially thinner than said edges of said right and left guard portions and said edges of said mainframe portion.

4. The molded blank for creating a backpack frame claimed in claim 2, further comprising, coupling means cooperating with said stop means for rigidly fixing said right and left guard portions to said mainframe when in a U-shaped position to form said backpack frame.

5. The molded blank for creating a backpack frame claimed in claim 1 further comprising, projection means on a face of said mainframe for fixing machinery between said right and left guard portions.

6. The molded blank for creating a backpack frame claimed in claim 1, wherein said mainframe has an opening for a backpad.

7. The molded blank for creating a backpack frame claimed in claim 1, wherein said mainframe has a shoulder belt mounting on an upper edge.

* * * * *